US006458320B1

(12) United States Patent
Libutti et al.

(10) Patent No.: US 6,458,320 B1
(45) Date of Patent: Oct. 1, 2002

(54) GALVANIZED METAL CORROSION INHIBITOR

(75) Inventors: Bruce L. Libutti, Teaneck; Joseph Mihelic, Sparta, both of NJ (US)

(73) Assignee: Ashland Inc., Covington, KY (US)

( * ) Notice: Subject to any disclaimer, the term of this patent is extended or adjusted under 35 U.S.C. 154(b) by 0 days.

(21) Appl. No.: 09/287,206

(22) Filed: Apr. 5, 1999

(51) Int. Cl.[7] ..... C23F 11/04

(52) U.S. Cl. ..... 422/16; 422/17; 422/12; 252/392; 252/394

(58) Field of Search ..... 134/3, 41; 422/14, 422/16, 17, 12; 252/392, 394

(56) References Cited

U.S. PATENT DOCUMENTS

| | | | | |
|---|---|---|---|---|
| 3,573,225 A | * | 3/1971 | Kondo et al. | 252/392 |
| 4,113,498 A | | 9/1978 | Rones et al. | |
| 4,233,176 A | * | 11/1980 | Conner, Sr. | 252/392 |
| 4,979,220 A | | 12/1990 | Chen | |
| 5,360,488 A | | 11/1994 | Hieatt et al. | |
| 5,451,335 A | | 9/1995 | Hieatt et al. | |
| 5,494,527 A | | 2/1996 | Ludwig et al. | |
| 5,527,395 A | | 6/1996 | Perry et al. | |
| 5,609,692 A | | 3/1997 | Johnson et al. | |
| 5,909,742 A | * | 6/1999 | Ouyang et al. | 134/3 |

FOREIGN PATENT DOCUMENTS

| | | | |
|---|---|---|---|
| EP | 0 807 695 A1 | | 11/1997 |
| WO | WO-96/39549 A1 | * | 12/1996 |

OTHER PUBLICATIONS

Cortec Corporation Product Data Sheet for S–69 with attachment, prior art.
Cortec Corporation Material Safety Data Sheet for S–69, prior art.

* cited by examiner

*Primary Examiner*—Elizabeth McKane
(74) *Attorney, Agent, or Firm*—David L. Hedden

(57) ABSTRACT

This invention relates to a galvanized metal, typically steel, corrosion inhibitor concentrate comprising (a) an amine salt of a fatty acid or an amine salt of a derivative of a fatty acid, (b) preferably a salt of a non polymeric aromatic acid, and (c) preferably a nonionic or anionic surfactant, and water. The invention also relates to a process for inhibiting corrosion and/or stripping of galvanized steel subjected to acidic conditions, e.g. an amine citrate or citric acid cleaning solution.

9 Claims, No Drawings

GALVANIZED METAL CORROSION INHIBITOR

FIELD OF THE INVENTION

This invention relates to a galvanized metal, typically steel, corrosion inhibitor concentrate comprising (a) an amine salt of a fatty acid or an amine salt of a derivative of a fatty acid, (b) preferably a salt of a non polymeric aromatic acid, and (c) preferably a nonionic or anionic surfactant, and water. The invention also relates to a process for inhibiting corrosion and/or stripping of galvanized steel subjected to acidic conditions, e.g. an amine citrate or citric acid cleaning solution.

BACKGROUND OF THE INVENTION

Steel and other metals are often galvanized by electroplating a layer of a more active metal, e.g. zinc, on the surface of the base metal to make the metal more corrosion resistant. Galvanized steel is particularly useful in open circulating aqueous systems. Even though electroplating provides added protection to the metal against corrosion, the galvanized layer of the metal can degrade, corrode, or strip from the metal surface, particularly when the galvanized metal surfaces are exposed to acidic or sequestering solutions over time.

One common manner in which the galvanized coating is exposed to acids and/or sequesterants is during cleaning. The cleaners are used to remove corrosion products from the metal surfaces, e.g. iron oxide from corrosion. Often cleaning solutions which are acidic or moderately acidic are used to clean the metals found in open circulating aqueous systems. These cleaners often contain citric acid, amine citrates and/or other sequestering agents. There are established dosages for cleaners that vary for on-line and off-line cleaning applications. The dosages typically recommended are from 50 ppm to 10 percent (100,000) ppm. Although these cleaners are effective in removing corrosion products, they can cause the galvanized layer of the metal surface to strip from the metal surface after one or more cleanings.

Some corrosion inhibitors for galvanized surfaces are available, but they are normally functional under conditions of normal equipment service, not under the stressed conditions of chemical cleaning. European Patent Application EP 0 807 695 discloses a non-phosphorus corrosion inhibitor for industrial cooling water and airwasher systems. The corrosion inhibitor contains (1) a hydroxycarboxylic acid or water-soluble salt thereof, (2) a polyacrylate or water soluble salt thereof, and (3) a water-soluble polymer which acts as a dispersant. The corrosion inhibitor is used in aqueous solutions having a pH range $\geqq 7$. On the other hand, U.S. Pat. No. 4,113,498 discloses a corrosion inhibitor for metal surfaces, which is the reaction product of an aliphatic carboxylic acid, a polyhydroxy carboxylic acid, and an alkanolamine. The corrosion inhibitor is used in aqueous solutions having a pH range of 7.5 to 10.0.

There is a need to develop a low-to-moderate pH corrosion inhibitor for zinc galvanized steel which can be used during the cleaning process without disrupting it. Such a corrosion inhibitor must be comprised of components that are environmentally acceptable. It must not appreciably interfere with the removal of corrosion products by the cleaner, and at the same time must protect the galvanized surface from attack by the cleaner.

SUMMARY OF THE INVENTION

This invention relates to a for galvanized metal, typically steel, corrosion inhibitor concentrate comprising:

(a) an amine salt of a fatty acid or an amine salt of a derivative of a fatty acid;

(b) preferably a salt of a non polymeric aromatic acid;

(c) preferably a nonionic or anionic surfactant having an HLB of 1 to 20; and (d) water.

In contrast to the corrosion inhibitors of European Patent Application EP 0 807 695 A1 and U.S. Pat. No. 4,113,498, mentioned previously, which are typically used in aqueous solutions having a pH greater than 7.5, the subject corrosion inhibitor concentrate can be used in aqueous solutions having a lower pH, for instance such as from 2 to 8, preferably from 4.9 to 8, when used at the suggested dosage. A relatively small amount of the corrosion inhibitor protects galvanized steel from attack during the cleaning process, particularly from the amine citrate used in iron oxide cleaners. The corrosion inhibitor will inhibit corrosion and retard the stripping of galvanized layer on galvanized steel. It does this without adversely affecting the effectiveness of the cleaning solution. The components of the corrosion inhibitor do not create stress on the environment.

The invention also relates to a process for inhibiting corrosion and/or stripping of galvanized steel subjected to acidic conditions, e.g. an amine citrate or citric acid cleaning solution.

BEST MODE AND OTHER MODES

The amine salts of fatty acids or the amine salts of derivatives of fatty acids used in the concentrate are formed by neutralizing a carboxylic acid with an amine. The carboxylic acid used may be a saturated or unsaturated, mono-, di-, or polycarboxylic acid having a least six-carbon atoms per functional group. Specific examples include, but are not limited to, capric acid, lauric acid, and palmitic acid. Most preferably used as the carboxylic acid are higher fatty acids such as rosin acids, tall oil, and their derivatives, most preferably a $C_{21}$ dicarboxylic acid. Other useful derivatives include partial esters of maleated tall oil fatty acid. The amine used to form the amine salt of a fatty acid or derivative thereof can be any primary, secondary, or tertiary aliphatic amine. Examples include alkylamines, for instance methylamine, ethylamine, propylamine, and butylamine; alkanolamines, for instance as monoethanolamine, diethanolamine, and triethanolamine; morpholine; and cyclohexylamine. Preferably, the amine is triethanolamine, or N, N-diethylethanolamine, dimethylamine, 1,2-diaminoethane, diaminopropane, ethanolamine, 2-methyl-2-amino-1-propanol, 5-aminopentanol, methoxypropylamine.

The amount of carboxylic acid and amine used to form the amine carboxylates can vary over wide ratios, but the amount typically used is such that the ratio of carboxyl groups of the carboxylic acid to amino groups of the amine is from 4:1 to 1:4, preferably about 2:1 to 1:2, most preferably about 1:1.

Although the amine salts can be used alone as corrosion inhibitors for galvanized metals, they are preferably used in combination with a salt of a non-polymeric aromatic acid. Preferably used as the salt of the non-polymeric aromatic acid are the alkali metal salt& of benzoic acid. The amount of salt of the non polymeric aromatic acid used is from 1:5 to 5: 1, parts by weight, 0.5:1 to 3:1 parts by weight based upon the total weight of the amine salt used, most preferably from 1:1 to 2:1.

Another optional, but preferred, component of the concentrate is a nonionic or anionic surfactant having hydrophilic-lipophilic balance (HLB) of 1–20. Preferably the surfactant is a polyoxyethylene-polyoxypropylene nonionic surfactant, having an average molecular weight of about 1000 to 10,000, preferably from 3000 to 5000, and a hydrophobe to hydrophile ratio of about 1:1 to 10:1, preferably from 3:1 to 10:1. The amount of nonionic surfactant use is from 1:30 to 2:1, preferably from 1:6 to 1:8. Other useful surfactants include linear alcohol ethoxylates, for example, one with 12 to 15 carbon atoms and 9 moles of ethoxylation; and alkali metal salts of fatty acids, for example, oleic acid.

Optional components include tolyltriazole, benzotriazole or the like for additional protection of yellow metals.

The corrosion inhibitor is most conveniently formulated as an aqueous solution of about 30 to 50 percent solids with a pH of about 7.3 to 7.8, preferably about 7.5. The aqueous solution may be added directly to the aqueous system containing the metal to be cleaned.

Typically the concentrate will contain from 5 to 30 parts by weight of amine salt, from 10 to 40 parts by weight of alkali benzoate, from 1 to 10 parts by weight of nonionic surfactant, and from 40 to 85 parts by weight of water, where said parts by weight is based upon the total weight of the concentrate. Preferably the concentrate will contain from 10 to 20 parts by weight of amine salt, from 20 to 40 parts by weight of alkali benzoate, from 1 to 5 parts by weight of nonionic surfactant, and from 50 to 70 parts by weight of water, where said parts by weight is based upon the total weight of the concentrate.

The dosage of the corrosion inhibitor used in the aqueous system varies over wide ranges and will depend upon a number of variables, for example whether the cleaning is off-line or on-line; the pH of the system treated; the type of cleaner being used; and the concentration of the cleaner being used. Typically the range will be on a solids basis from 20 ppm to 4000 ppm, more typically from 40 ppm to 3000 ppm, and most typically from 200 ppm to 2000 ppm. When used in a system cleaned off line by a moderate pH cleaner, the range will be from 500 ppm to 3000 ppm, preferably from 1000 ppm to 2000 ppm. When used in a system cleaned off-line by an acidic cleaner, the range will be from 1000 to 4000 ppm, preferably from 1000 to 3000 ppm.

When used in a system cleaned on-line by a moderate pH cleaner, the range will be from 20 to 300, preferably from 40 to 200 ppm. The corrosion inhibitor is particularly suited for aqueous systems having a pH of 2.5 to 8, particularly those containing a cleaner. After the cleaner and galvanized steel corrosion inhibitor are added to the aqueous system and allowed to operate, the aqueous system is usually flushed with water to remove cleaner and galvanized steel corrosion inhibitor and accumulated, dissolved corrosion products. Cleaning off-line generally takes about 24 hours to 14 days. Cleaning on-line generally takes several days to several weeks.

DEFINITIONS AND ABBREVIATIONS

| | |
|---|---|
| CASC = | a citric acid sequestering cleaner which contains citric acid as the only major active component in amount of 50 parts in 100 based upon the weight of the cleaner. The cleaner also contains a minor amount of a complexing chelating agent. |
| DEEA = | N,N-diethylethanolamine. |
| DFE = | dissolved soluble iron. |
| DFZ = | dissolved soluble zinc. |
| DIACID = | a $C_{22}$ diacid sold by WESTVACO as DIACID 1550. |
| DWS 2041 = | a cooling water treatment which contains 6 percent sodium molybdate, lesser amounts of phosphonates, acrylic polymer and tolyltriazole, and sodium hydroxide to adjust the pH. |
| FERROCLEAN = | a moderately acidic pH (5–6) sequestering cleaner sold by the Drew Industrial Division of Ashland Chemical Company consisting of about 15 parts citric acid, about 20 parts of triethanolamine, and the balance water, based upon 100 parts cleaner. FERROCLEAN may also contain minor amounts of anionic copolymer, anionic surfactant, complexing chelating agent (EDTA), copper corrosion inhibitor (benzotriazole), and/or a silicone containing antifoamer. |
| PP = | PLURONIC ® Polyol L101, a polyoxypropylene-polyoxyethylene copolymer nonionic surfactant sold by BASF Corporation having an HLB value of 1, and an average molecular weight of about 3800, and hydrophobic and hydrophilic segments where the weight ration of hydrophobe to hydrophile is about 9 to 1. |
| MPY = | corrosion rate in mils per year. |
| SALT = | salt of DIACID and DEEA |
| SBEN = | sodium benzoate |

EXAMPLES

CGI (a dilute solution of a corrosion inhibitor within the scope of this invention), or in some cases individual component of CGI, is used in the Examples which follow. Except as otherwise stated, the formulation for GCI used in the Examples is shown in Table I that follows. The neat pH of GCI is 7.6. CGI was added directly to the test water.

TABLE I

| GCI INHIBITOR FORMULATION | |
|---|---|
| Deionized water | 59.1 parts |
| DEEA | 4.0 parts |
| DIACID | 8.7 parts |
| Sodium benzoate (SBEN) | 26.2 parts |
| PLURONIC Polyol L101 (PP) | 2.0 parts |
| Total | 100.0 parts |

The GCI solution was evaluated as a corrosion inhibitor for hot dip zinc galvanized carbon steel coupons and C 1010 mild steel coupons in 1% and 10% solutions of FERROCLEAN and 0.75% and 0.25% citric acid sequestering cleaning solutions (CASC) in water. It was similarly evaluated, along with the cleaners, with pre-rusted C1010 mild steel coupons to determine whether GCI interfered with the removal of iron oxide deposits. The water contained 200 mg/l DW 2041 cooling treatment additive to simulate addition of the cleaner and the inhibitor to a water system without a preliminary drain and flush. The initial pH and fmal pH of the cleaning solution are given in the tables.

The pre-rusted mild steel coupons are prepared for the test by corroding them in a salt fog spray unit for three to four weeks to develop thick and heavy iron oxide deposits. After the corroded coupons were removed from salt fog spray unit, they were rinsed with tap water to remove sodium chloride. The coupons were dried at room for approximately one week before using them in a cleaning test. The treated coupons contain rust and other iron oxide layers on the metal substrate of the coupon. These rusted coupons were used in rust removal evaluations to measure the effect of galvanized steel corrosion inhibitors on the rust removal process.

The treated hot dip zinc galvanized carbon steel coupons and mild steel C1010 coupons are immersed in the cleaning solutions without (Control) and with corrosion inhibitors. The glass jars containing the coupons are attached to a shaker and shook at shaker speeds of about 150±10 rpm over about 14 days for FERROCLEAN and two days for citric acid at room temperature, unless other conditions are specified in the Tables which follow. After exposing the metal coupons to the Control and aqueous solutions of the concentrates, the amount of iron and zinc in solution is measured which reflects the ability of GCI to prevent the corrosion of the galvanized zinc. The coupons are examined to determine the effectiveness of protection of the galvanized layer. Coupon weight loss is measured to determine the overall corrosion rate.

The effectiveness of GCI will be reflected by, a decrease in DFZ and DFE (less corrosion of galvanized steel due to GCI), and less overall corrosion (MPY), and less visible attack on the galvanizing.

The pre-rusted coupons were treated in the same way in separate tests. After exposure they were dried and the weight loss determined to indicate the removal of the corrosion products. The decrease in the effectiveness of the cleaners caused by the GCI was noted.

Table II shows data related to the effect of using the various components of GCI alone as galvanized corrosion inhibitors in a 10% aqueous solution.

TABLE II

CORROSIVITY MEASUREMENTS OF COMPONENTS OF GCI AND GCI IN 10% FERROCLEAN SOLUTIONS CONTAINING COUPONS OF GALVANIZED STEEL

| Example | Additive | Initial pH | Final pH | DFE (mg/l) | DZN (mg/l) | MPY | Appearance |
|---|---|---|---|---|---|---|---|
| Control | No additive | 4.9 | 6.4 | 2131 | 2064 | 52 | Galvanized layer was stripped. |
| 1 | Salt of 435 mg/L DIACID and 200 mg/L DEEA | 4.9 | 5.0 | 0.2 | 108 | 2.5 | Galvanized layer was intact and there was film on jar. |
| COMPARISON A | 1310 mg/L SBEN alone | 4.9 | 6.6 | 1624 | 2375 | 47 | Galvanized layer was stripped. |
| 3 | 1 + A | 4.9 | 4.9 | 0.1 | 63 | 0.9 | Galvanized layer was intact and there was film on jar. |
| 4 | 5000 ppm GCI[1] | 4.9 | 4.9 | 0.5 | 57 | 0.7 | Galvanized layer was intact and there was no film on jar. |

[1]GCI = formulation of Example 3 plus 100 mg/L of PP.

The data in Table II indicate that the addition of the salt of DIACID and DEEA reduced corrosion when compared to the control (Example 1). On the other hand, SBEN was not effective in reducing corrosion when used alone (Comparison A). However, when the SBEN was used in conjunction with the salt of the DIACID and DEEA, corrosion of zinc galvanized steel and C1010 mild steel was reduced even more than when the salt of DIACID and DEEA was used alone (Example 2). The fuirther addition of PP prevented any deposition of the GCI (Example 3).

Table III shows the results of experiments using the amine salts alone. Amine salts of rosin acids were compare to the amine salt of a DIACID with respect inhibiting the corrosion of galvanized surfaces.

TABLE III

CORROSIVITY MEASUREMENTS OF AMINE SALTS ALONE IN 10% FERROCLEAN SOLUTION CONTAINING COUPONS OF GALVANIZED STEEL

| Example | Product Solution | Initial pH | Final pH | DFE (mg/l) | DZN (mg/l) | MPY | Appearance |
|---|---|---|---|---|---|---|---|
| CONTROL | No additive | 4.6 | 6.4 | 2131 | 2064 | 52 | Galvanized layer was stripped. |
| 5 | Salt of 200 mg/l DEEA + 435 mg/l Acintol D40LR (35–45% rosin acid) | 4.9 | 5.0 | 0.1 | 93.2 | 1.6 | Galvanized layer had numerous spots/damage. |
| 6 | Salt of 200 mg/l DEEA + 435 mg/l Pamak C6B (12–22% rosin acid) | 4.9 | 5.0 | 0.3 | 108.6 | 2.0 | Galvanized layer had numerous spots/damage. |
| 7 | Salt of 200 mg/l DEEA + 435 mg/l DIACID | 4.9 | 5.0 | 0.2 | 107.5 | 2.5 | Galvanized layer was fine. |

Table III shows that amine salts of rosin acids provided protection to galvanized surfaces, although the amine salt of the DIACID performed better. Although there was damage to the galvanized surface when the salts of the rosin acid were used, the amount of soluble iron and zinc indicate that corrosion was substantially prevented. Even though one may anticipate fuiture corrosive attack on the damaged areas, without the inhibitor the steel would have been left completely unprotected.

Table IV shows data related to the use of GCI as a corrosion inhibitor at the lower pH used in citric acid cleaning.

TABLE IV

CORROSIVITY MEASUREMENTS OF GCI IN CITRIC ACID SOLUTIONS CONTAINING COUPONS OF GALVANIZED STEEL

| Example | Product Solution Additive | Initial pH | Final pH | DFE (mg/l) | DZN (mg/l) | MPY | Appearance |
|---|---|---|---|---|---|---|---|
| CONTROL | 7500 mg/l Citric Acid Solids. No additive | 2.4 | 4.6 | 710 | 2183 | 300.8 | Galvanizing 100% removed. |
| 8 | 7500 mg/l Citric Acid Solids + 5000 mg/l GCI | 2.8 | 3.0 | 4.0 | 404.4 | 28.1 | Galvanizing intact. |
| CONTROL | 2500 mg/l Citric Acid solids. No additive | 2.7 | 7.2 | 12.4 | 1277 | 142.4 | Galvanizing 100% removed. |
| 9 | 2500 mg/l Citric Acid Solids + 2500 mg/l GCI | 3.1 | 3.6 | 0.4 | 338.7 | 27.1 | Galvanizing intact. |

Table IV shows that GCI is effective at the lower pH of citric acid cleaning.

Tables V and VI show that GCI protects new mild steel from concentrations of Ferroclean which are used in cleaning corrosion products from water solutions. The required dose is less than that needed to protect galvanized surfaces.

TABLE V

CORROSIVITY MEASUREMENTS OF GCI IN 10% FERROCLEAN SOLUTIONS CONTAINING COUPONS OF C1010 MILD STEEL

| Example | Additive | Initial pH | Final pH | DFE (mg/l) | Corrosion Rate mpy |
|---|---|---|---|---|---|
| CONTROL | No additive | 4.9 | 7.2 | 4998 | 77.2 |
| 10 | 750 mg/l GCI | 4.9 | 4.9 | 234.4 | 2.8 |

TABLE VI

CORROSIVITY MEASUREMENTS OF GCI IN 1% FERROCLEAN SOLUTIONS CONTAINING COUPONS OF C1010 MILD STEEL

| Example | Additive | Initial pH | Final pH | DFE (mg/l) | Corrosion Rate mpy |
|---|---|---|---|---|---|
| CONTROL | No additive | 5.1 | 6.5 | 2605 | 34.7 |
| 11 | 750 mg/l GCI | 5.2 | 5.9 | 71.9 | 1.6 |

Tables VII, VIII and IX show that GCI reduced the iron oxide removal rate of both Ferroclean and citric acid. However the cleaning rate was still acceptable. Thus GCI protected new steel and galvanizing while permitting satisfactory cleaning, i.e. removal of corrosion products.

TABLE VII

IRON OXIDE CLEANING/10% FERROCLEAN SOLUTION AND GCI

| Example | Additive | Avg. % Iron Oxide Removed |
|---|---|---|
| CONTROL | No additive | 95.02% |
| 13 | 10% Ferroclean solution + 200 mg/l DEEA + 435 mg/l DIACID + 1310 mg/l SBEN + 100 mg/l PP (5000 ppm GCI) | 72.46% |

TABLE VIII

IRON OXIDE CLEANING/1% FERROCLEAN SOLUTION AND GCI

| Example | Additive | Avg. % Iron Oxide Removed |
|---|---|---|
| CONTROL | No additive | 11.95% |
| 14 | 100 mg/l DEEA + 217.5 mg/l DIACID +655 mg/l SBEN + 50 mg/l PP (2500 ppm GCI) | 8.61% |

TABLE IX

IRON OXIDE CLEANING/CITRIC ACID SOLUTIONS AND GCI

| Example | Additive | Avg. % Iron Oxide Removed |
|---|---|---|
| CONTROL | 7500 mg/l Citric Acid Solids. | 78.41% |
| 15 | 7500 mg/l Citric Acid Solids + 5000 mg/l GCI | 65.38% |

We claim:

1. A galvanized metal corrosion inhibitor composition comprising an aqueous solution of:

(a) an amine salt selected from the group consisting of a fatty acid amine salt, derivatives of a fatty acid amine salts, and mixtures thereof;

(b) an alkali metal benzoate wherein the weight ratio of (a) to (b) is from 1:5 to 5:1; and (c) a nonionic polyoxypropylene-polyoxyethylene block copolymer such that the weight ratio of nonionic polyoxypropylene-polyoxyethylene block copolymer to amine salt is from 1:6 to 1:8.

2. A process for inhibiting corrosion of galvanized metal surfaces exposed to an aqueous solution of an acidic cleaning solution, wherein said aqueous solution has a pH of 2 to 8, comprising:

contacting a galvanized metal surface, which is in contact with an aqueous solution containing an acidic cleaner, with a galvanized metal corrosion inhibitor composition comprising an aqueous solution of:

(a) an amine salt selected from the group consisting of a fatty acid amine salt, derivatives of a fatty acid amine salts, and mixtures thereof; and (b) a salt of a non-polymeric aromatic acid, wherein the weight ratio of (a) to (b) is from 1:5 to 5:1 in an effective corrosion inhibiting amount.

3. The process of claim 2 wherein said process is an off-line process.

4. The process of claim 2 wherein said process is an on-line process.

5. The process of claim 2 wherein component (a) is used in an amount of from 5 to 30 parts by weight based upon the amount of corrosion inhibitor composition, component (b) is an alkali metal salt used in an amount of from 10 to 40 parts by weight based upon the amount of corrosion inhibitor composition, and the amount of water in the corrosion inhibitor composition is from 40 to 85 parts by weight, where said parts by weight is based upon the total weight of the corrosion inhibitor composition.

6. The process of claim 5 wherein component (b) is an alkali metal benzoate.

7. The process of claim 6 which additionally comprises a surfactant selected from the group consisting of, nonionic surfactants, and mixtures thereof such that the weight ratio of surfactant to amine salt is from 1:30 to 2:1.

8. The process of claim 7 wherein the surfactant is a nonionic polyoxypropylene-polyoxyethylene block copolymer such that the weight ratio of nonionic polyoxypropylene-polyoxyethylene block copolymer to amine salt is from 1:6 to 1:8.

9. The process of claim 8 wherein the acidic cleaner contains amine citrate.

* * * * *